US006571432B1

(12) United States Patent
Rindle

(10) Patent No.: US 6,571,432 B1
(45) Date of Patent: Jun. 3, 2003

(54) HIDDEN CLOSURE

(75) Inventor: Markus M. H. Rindle, Boulder, CO (US)

(73) Assignee: Salomon S.A. (FR)

( * ) Notice: Subject to any disclaimer, the term of this patent is extended or adjusted under 35 U.S.C. 154(b) by 0 days.

(21) Appl. No.: 09/710,126

(22) Filed: Nov. 9, 2000

(51) Int. Cl.[7] ..... A44B 19/34
(52) U.S. Cl. ..... 24/432; 24/389
(58) Field of Search ..... 24/389, 432, 384, 24/381, 682.1, 396; A44B 19/32

(56) References Cited

U.S. PATENT DOCUMENTS 3,002,244 A * 10/1961 McNamara ..... 112/406
3,490,109 A 1/1970 Heimberger
3,624,871 A 12/1971 Osterkorn
3,685,103 A * 8/1972 Severino ..... 24/304
3,962,729 A * 6/1976 Cook ..... 2/234
4,194,041 A 3/1980 Gore et al.
4,353,760 A * 10/1982 Moertel ..... 156/66
4,601,085 A 7/1986 Yoshida et al.
4,888,859 A 12/1989 Horita
4,987,657 A * 1/1991 Moreland ..... 24/389
5,159,719 A * 11/1992 Aumann ..... 2/87
5,400,441 A * 3/1995 Yoshida ..... 530/859
5,427,849 A * 6/1995 McClintock et al. ..... 138/128
5,444,898 A * 8/1995 Norvell ..... 24/389
5,526,534 A * 6/1996 Lazar ..... 112/424
5,532,037 A * 7/1996 Aumann ..... 2/135
5,608,916 A * 3/1997 Aumann ..... 2/247
5,730,498 A * 3/1998 Hanson et al. ..... 2/2.17
5,924,172 A 7/1999 Klein
6,052,826 A * 4/2000 Tolton ..... 2/108

* cited by examiner

*Primary Examiner*—J. J. Swann
*Assistant Examiner*—André L. Jackson
(74) *Attorney, Agent, or Firm*—Patton Boggs LLP

(57) ABSTRACT

A first panel-like element has a longitudinal fold near a first longitudinal edge. A second panel-like element has a longitudinal crease near a second longitudinal edge. The first longitudinal edge and second longitudinal edge are parallel to each other and form a longitudinal opening. A fastener is disposed at said longitudinal opening. When the fastener of the closure is closed, the first element and a second element form a flat, longitudinal flap, and the longitudinal opening and the fastener are located on the inside surface of the flap.

51 Claims, 8 Drawing Sheets

HIDDEN CLOSURE

BACKGROUND OF THE INVENTION

1. Field of the Invention

The invention relates to hidden closures for jackets, trousers, luggage and other articles, in particular, to weather-resistant slide fastener closures.

2. Statement of the Problem

In recent years, there have been significant improvements in the development of weather-resistant fabrics for a wide variety of applications, such as outdoor clothing, sports equipment, and luggage. In addition to improved nylon materials with coatings of polyurethane, polyethylene or similar polymers, a number of comfortable "breathable" waterproof fabrics have been developed that repel water while permitting the dissipation of water vapor (e.g., perspiration). For some years, weather-resistant articles have been produced from materials which permit passage of water vapor while preventing passage of liquid water. These articles provide increased comfort by permitting moisture vapor created by the wearer's perspiration to escape from within the article while in use. An example of this material is a breathable waterproof laminated fabric containing a layer of expanded porous polytetrafluoroethylene (PTFE) coated with a breathable polyurethane polymer, as described in U.S. Pat. No. 4,194,041 issued Mar. 18, 1980 to Gore et al.

To construct weather-resistant articles, waterproof or weather-resistant material typically is cut into pattern pieces and sewn together. Care must be taken in the design of weather-resistant articles to allow sealing of seams present in the waterproof material used to form the article. Closures containing snaps, buttons or slide fasteners, commonly referred to as "zippers", have been used in the design of weather-resistant articles. With the improvements in waterproof fabrics, the seams connecting the fabric material have become a principal location where water penetration tends to occur. This problem is probably most severe at seams connected with resealable closures, such as access zippers, zippered pockets, underarm ventilation zippers, and other openings provided for adjustable ventilation. While these resealable closures are necessary for the proper functioning of the product, they have proven to be particularly difficult to seal properly. In the case of closures of slide fasteners having teeth, and attached with fabric stringer tapes, liquid may pass between gaps in the teeth of the slide fastener or between the fibers of the fabric stringer tapes. Liquid may also wick tangentially from the teeth along the fabric surface of the stringer tapes, thereby entering the article. It will also pass via the needle holes of stitched seams resulting from sewing the stringer tapes to the article with thread.

A number of attempts have been made to develop a slide fastener that is resistant to the passage of water. Some solutions have been directed to making the zipper structure itself water impervious. Other solutions have relied on forming. an interlocking fit with ancillary material directly adjacent the zipper such that the ancillary material forms a barrier between the environment and the zipper. An example of the latter can be found in U.S. Pat. No. 3,490,109 issued Jan., 1970, to Heimberger. Another solution exemplified in U.S. Pat. No. 3,624,871 issued December, 1971, to Osterkorn, provided for highly overlapped zipper flaps that extended over the outer zipper structure. While the structure provided a low-cost solution to the challenge, the deficiency of this design, however, was the structure's failure to provide some positive means for maintaining the overlap. In a variation of this solution, disclosed in U.S. Pat. No. 5,924,172 issued Jul. 20, 1999 to Klein, a conventional slide fastener having two stringer tapes is used with a fluid resistant structure. Two sheaths are incorporated into a closable structure, in overlapping fashion, at or near the opening of the structure. In U.S. Pat. No. 4,601,085 issued Jul. 22, 1986, to Yoshida et al., a slide fastener is disclosed with a stringer tape made water-resistant through one of a variety of methods, including attaching multiple layers of water sealant material or constructing the entire stringer tape from waterproof material. To improve water-tightness, the patent employs dual rows of offset slide fastener elements with a barrier layer of stringer tape mounted across the opening between them. This approach is deficient in a number of respects. First, the mechanisms taught for imparting waterproofness are difficult and costly to implement. Second, the patent offers only partial solutions to avoid seepage of water through stitched seams holding the slide fastener elements in place. Third, the patent is silent as to how to mount the zipper to avoid leakage through the seams anchoring the stringer tapes to the fabric. Finally, the use of an intermediate barrier layer, and especially the suggested double coupling construction, makes the closure bulky and tends to hinder unrestricted operation of the zipper.

Some of these deficiencies are addressed in U.S. Pat. No. 4,888,859 issued Dec. 26, 1989, to Horita. In this patent, a single row of zipper elements is anchored to a stringer tape and then the stringer tape is coated on one side by a waterproof layer. To resist water seepage through the slide fastener elements, the teeth are mounted to create a barrier layer with the stringer tapes abutting one another in a closed position. Although the Horita zipper may avoid a seepage problem for the stitches holding the zipper elements in place, this design is also deficient in a number of respects. The patent provides no teaching of how to attach the zipper to fabric or how to avoid seepage through seams which may be used to anchor the stringer tapes in place.

In light of these difficulties, a common method used today for protecting a zippered opening in a water-resistant garment is to install a conventional zipper in conjunction with one or more storm flaps or other separate barrier layer. These flaps are attached to a garment to cover and/or back the zipper and prevent water from passing through. Weather-resistant articles have additionally required a storm fly flap or flaps to be placed externally over the closures to prevent the closures from coming in direct contact with a forceful spray of liquid and allowing liquid to pass between gaps in the closure. Nevertheless, storm fly flaps are bulky, require sewing and sealing the article to be effective, and all are aesthetically limiting to article manufacturers desiring to design sleek and fashionable weather-resistant articles. Outside storm flaps are normally held in place with a series of snaps or hook-and-loop fasteners. Storm layers are effective at eliminating water seepage. Unfortunately, storm flaps tend to be expensive to manufacture and attach, requiring a significant amount of material and numerous additional mounting steps. Further, such barrier layers restrict ready user access to the zipper and, if not properly constructed, are prone to being caught in the zipper. Moreover, storm flaps in weather-resistant garments are overly bulky, limit the range of design options, and lead to the garments looking too similar to one another.

A common disadvantage of closure systems of the prior art is that one or more stitched seams are required to form a fly or flap of material in an object to cover the closure. The stitched seams interrupt the smoothness of the outside surface. Also, the extra features added to enhance water-resistance increase bulkiness. As a result, closures of the prior art typically detract from the appearance of objects and limit their aesthetic design.

SUMMARY OF THE INVENTION

The invention solves the above problems by providing a hidden closure that includes a fastener and a flap covering the fastener, in which the fastener is located on the interior side of the flap. This has a number of immediate advantages over the prior art. The hidden closure system is less bulky than many prior art fasteners. The closure has no or few stitched seams exposed to the outside, resulting in a sleek, smooth outside surface. It is more difficult for leakage of water and other weather elements at the fastener to occur, since the leakage direction is opposite to the usual direction of fluid flow, that is, it is in a direction exterior to the garment or other item which is closed by the system. Moreover, any leakage that penetrates the fastener enters the interior of the flap, and not the interior of the item.

Preferably, the fastener includes two rows of fastener elements mounted on stringer tape, and the stringer tape is stiffer than the fabric or other panel material of which the item is made. This has another immediate advantage in that the stiffness of the stringer tape stiffens the flap, thereby maintaining the shape of the closure and better protecting the opening against the outside.

Preferably, the invention also includes a flap fastener to attach the distal end of the flap to the outer surface of the garment or other item. This holds the flap flat against the item for both improved water tightness and appearance. Preferably, the flap fastener comprises a hook-and-loop fastener or a magnet fastener.

The closure according to the invention is preferably formed by folding over the ends of the panels to be connected by the closure. One panel is overlapped longitudinally by the other with the folded portions between the overlapping and the overlapped portions of the panels. The edges of the folded over portions of the panels form a longitudinal opening which is closed by a fastener. The fastener is either glued or stitched to the folded portions. However, any attachment of either the fastener or folded portions to the overlapping portions preferably is glued. This results in a seamless, smooth, finished appearance, with the only evidence of the opening being the crease marking the folded end of the exterior panel.

Preferably, the fastener is a zipper in which the rows of fastener elements are rows of teeth mounted on stringer tape. Preferably, the teeth are mounted on the side of the stringer tape that faces the interior side of the exterior panel, that is, on the side facing the interior of the closure. Preferably, the zipper linkage tunnel is also positioned on the interior side of the tapes, and the zipper pull-tab extends from the linkage tunnel to the exterior side of the stringer tapes.

Preferably, the folded over portion of the interior one of the panels, and the stringer tape attached to the fastener elements if this is present, are stitched to the interior panel and the seam is covered by a sealant, such as waterproof sealing tape. This stitching defines the proximal end of the flap in this embodiment.

The panel construction can be one, two or three ply. A lining is preferably attached to the interior surface of the exterior panel.

The closure system according to the invention not only is extremely resistant to water, wind or other fluid penetrating into the interior of the garment or other item, but also presents a flat, smooth, and sleek appearance referred to herein as a "seamless flap construction". Numerous other features and advantages of a closure in accordance with the invention will become apparent when the description below is read in conjunction with the drawings.

DETAILED DESCRIPTION OF THE INVENTION

1. Overview

The invention is described below with the aid of FIGS. 1–12. It should be understood that FIGS. 1–12 are not intended to exactly represent any particular closure, but are intended to be schematic representations that more easily illustrate the features of the invention. A closure in accordance with the invention may be embodied in many variations that do not depart essentially from the embodiments described herein. It should be further understood that FIGS. 1–12 are only schematic depictions of closures in accordance with the invention, and these figures do not limit the scope of the invention, which is defined by the claims below.

Figure 1:
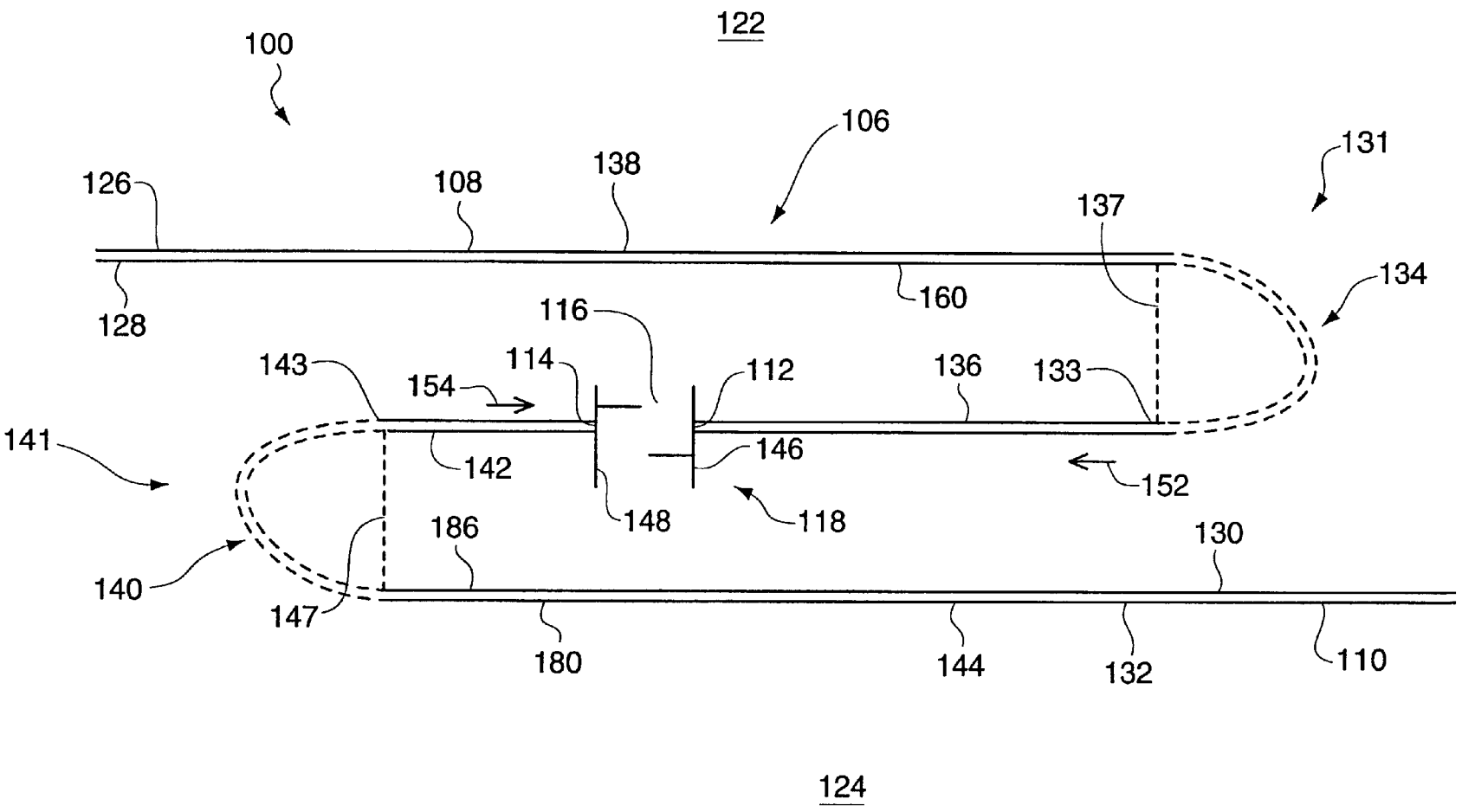
FIG. 1 depicts a schematic top end view of an article comprising a generalized hidden closure in accordance with the invention.

The invention provides a simple, effective, weather-resistant closure that can be integrated into a variety of types of articles, including jackets, pants, shoes, carrying bags and luggage. As depicted in FIG. 1, a first panel-like element 108 and a second panel-like element 110 of an article 100 to be closed separate an interior space 122 from an exterior space 124. Elements 108 and 110 include longitudinal edges 112 and 114, respectively, which edges are roughly parallel to each other and form a longitudinal opening 116. Note that the terms "longitudinal edge" and "longitudinal opening" are terms of art, and denote the edge and opening that extend in a direction into the paper in FIG. 1. A fastener 118 is disposed at longitudinal opening 116. When fastener 118 is closed, it is hidden from view from exterior 124. A closure in accordance with the invention is preferably constructed with no sewing stitches visible from exterior 124. Also, longitudinal opening 116 does not open directly into interior space 122. Therefore, even if a fluid, such as water or cold air, penetrates through a closed fastener 118, it does not pass directly into interior space 122.

Figure 6:
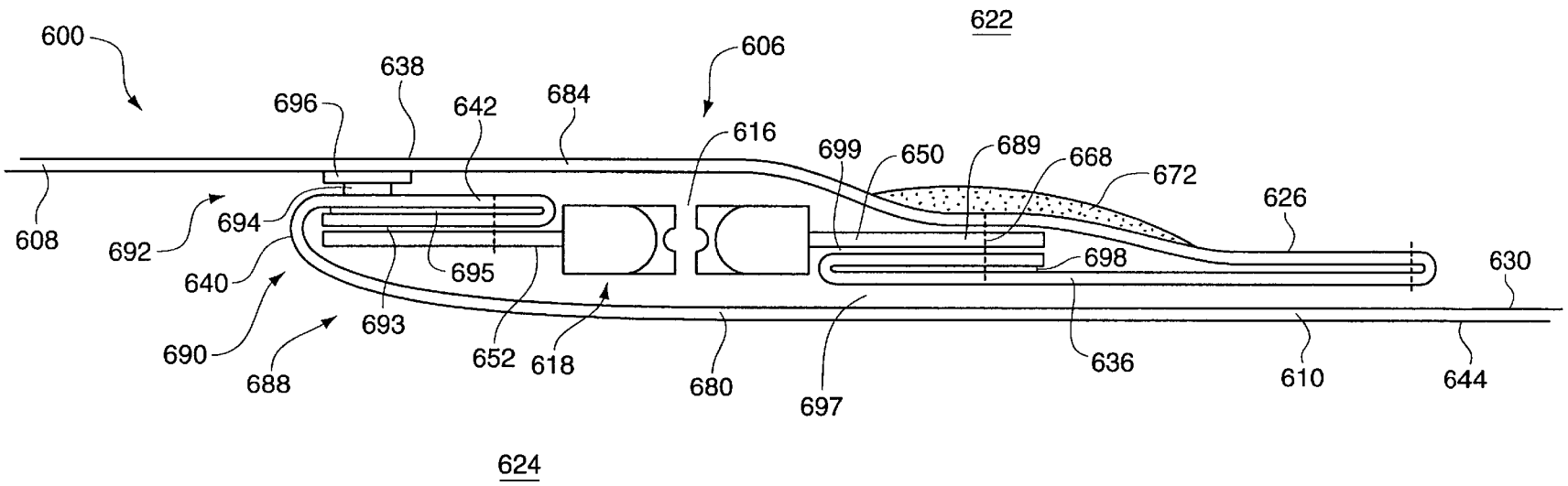
FIG. 6 depicts another top view of the closure similar to that of the closure of FIG. 2 with some variations.

As perhaps illustrated best in FIG. 6, the portion of the closure 606 from seam 668 to crease 640 forms a flap 688 having a proximal end 670 and a distal end 671.

Figure 8:
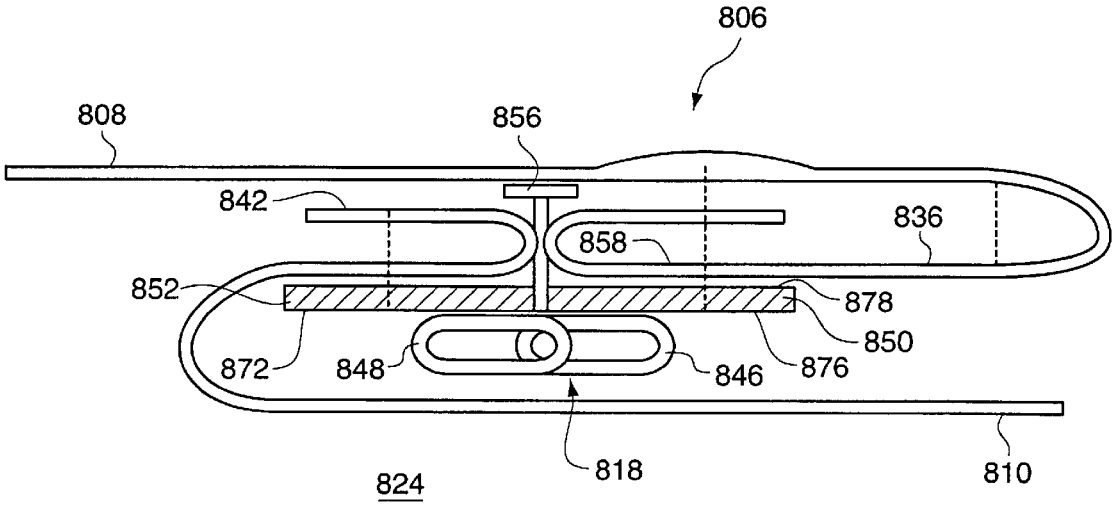
FIG. 8 depicts a further embodiment of a closure in accordance with the invention.

Fastener 618 forms a part of flap 688. The exposed portion of the flap 688, i.e., the overlying portion 680 of element 610 that covers the closure system 606 contains no stitching seams. Longitudinal opening 616 and fastener 618 are hidden from view by longitudinally overlying second panel portion 680 and shielded against direct exposure to exterior 624. Overlying panel portion 680 is preferably designed to lie flat against first element 608 so that only a single crease 640 is visible from the exterior. A flap fastener 692 is preferably included to maintain the flat, seamless appearance of the closure and to inhibit outside elements from reaching fastener 618. Fastener 618, however, is accessible for opening and closing by a user. Stitching seams, such as seam 668, are protected against direct exposure to exterior 624 by covering panel portion 680 of panel-like element 610. Even if a fluid is able to seep through seam 668, seal 672 covering the seam at interior surface 626 prevents the fluid from reaching interior 622. As a result, a closure in accordance with the invention provides advantages of an ice storm flap without the disadvantages of being bulky and expensive to manufacture. The fastener 618 is typically a slide fastener. Numerous types and variations of slide fasteners can be incorporated into a closure in accordance with the invention. As depicted in FIG. 8, preferably, rows of slide fastener elements 846, 848 are located on the inside surfaces of stringer tapes 850, 852, respectively. As a result, the gaps in openings inherent in slide fastener 818 are protected against direct exposure to the exterior 824. As depicted in FIGS. 9–12, a closure in accordance with the invention preferably includes a lining 985, 1085, 1185, 1285.

As can be seen from this overview, the closure is designed such that when the fastener is closed, it is hidden from view by a flap that is unobtrusive. Typically, the closure is fabricated with no sewing stitches visible from the exterior, and the closure flap lies flat over the longitudinal opening.

The term "longitudinal" in this disclosure is the long dimension of an opening that is to be opened or closed by closure in accordance with the invention. The term "lateral" refers to the dimension that is perpendicular to the longitudinal dimension of the opening and which is roughly parallel to the panels on each side of the longitudinal opening.

The terms "water-resistant", "weather-resistant" and "waterproof" are used somewhat interchangeably herein, and their meanings are not absolute and they are overlapping. It should be understood, however, that there are differences between the terms both in their plain meaning and in their use in the art. A waterproof object is generally impervious to the passage of water under its normal conditions of use. A water-resistant object resists the passage or seepage of water under normal operating conditions, but is not considered to be absolutely impervious to water, especially under prolonged exposure. The term "weather-resistant" is used herein to indicate that an object is resistant to weather elements in general, such as wind, cold air, rain and snow. It should be emphasized that a closure system in accordance with the invention is resistant to the passage of fluids in general. The word "fluid" herein means both gaseous and liquid fluids of all kinds, including but not limited to weather elements, such as rain, wind and cold air.

The word "adhesive" has a broad meaning, and refers generally to a substance used to bond two or more solids so that they act or can be used as a single piece. The word "glue" has a narrower meaning when used technically: i.e., it is a type of adhesive made from animal collagen. In this specification, however, the terms "adhesive" and "glue" are used in the common sense in which they are interchangeable, so that the word "glue" and related words also denote a non-glue adhesive.

2. Detailed Description

FIG. 1 depicts a generalized schematic top view of an article 100 comprising a hidden closure 106 in accordance with the invention. Closure 106 has a first element 108 and a second element 110, which are intended to be joined with a fastener 118. First element 108 comprises a fold part 136 and a first panel 138 and has a first longitudinal edge 112 at the distal end of fold part 136. Second element 110 comprises a crease part 142 and a second panel 144 and has a second longitudinal edge 114 at the distal end of fold part 142. First longitudinal edge 112 and second longitudinal edge 114 define a longitudinal opening 116. A fastener 118 is disposed at longitudinal opening 116 for joining first longitudinal edge 112 and second longitudinal edge 114. When fastener 118 is closed, element 108 and element 110 separate interior space 122 of article 104 from exterior space 124. First element 108 has a first interior surface 126 and a first exterior surface 128. Second element 110 has a second interior surface 130 and a second exterior surface 132. First exterior surface 130 faces said second interior surface 128. Fold part 136 is connected at its proximal end 133 to first panel 138 via a first longitudinal connection 131, and crease part 142 is connected at its proximal end 143 to second panel 144 via a second longitudinal connection 141. As will be discussed below in more detail, in the preferred embodiment, connection 131 is preferably a longitudinal fold 134 between fold part 136 and panel 138, and connection 141 is preferably a crease 140 between crease part 142 and second panel 144, though connection 131 can also comprise stitching 137, and connection 141 can also comprise stitching 147. That is, fold 134 is shown in ghost, because, generally, fold part 136 and first panel 138 can be connected in many ways, such as stitching, glue, etc., as indicated by dotted line 137. Similarly, crease 140 is shown in ghost, because, generally, crease part 142 and second panel 144 can be connected in many ways, such as stitching, glue, etc., as indicated by dotted line 147. No matter how fold part 136 is connected to first panel 138, it extends away from connection 131 in substantially the same direction as panel 138, i.e., in a first substantially lateral direction 152 from the connection 131 such that fold part 136 is adjacent to and preferably overlaps overlapped portion 160 of first panel 138. No matter how crease part 136 is connected to second panel 144, it extends away from connection 141 in substantially the same direction as panel 144, i.e., in a second substantially lateral direction 154 from the connection 141 such that crease part 142 is adjacent to and preferably overlaps overlapped portion 180 of second panel 144. Exposed panel 144 of second element 110 is disposed between exterior 124 and fastener 118. Thus, a portion of interior surface 130 of second panel 144 is directly adjacent to crease part 142, fastener 118, longitudinal opening 116 and fold part 136. As a result, covering portion 180 of second panel 144 of second element 110 shields crease part 142, fastener 118, longitudinal opening 116 and fold part 136 from exterior 124. When fastener 118 is closed, longitudinal opening 116 and fastener 118 are located between first exterior surface 128 and second interior surface 130. Typically, fastener 118 comprises a set of cooperating fastener elements 146, 148, fastener element 146 disposed on fold part 136, and fastener element 148 disposed on crease part 142.

As suggested above, the term "fold part" herein is not intended to inherently imply that it is connected to a fold, since the fold part 136 can be connected to the first panel 138 in ways other than a fold. However, the term is intended to inherently include the limitation that the part extends in a direction such that it overlaps a portion of the same one of the two elements to be joined, such as occurs when one portion of a panel is folded over another. Similarly, the term "crease part" herein is not intended to inherently imply that it is connected to a crease, since the crease part 142 can be connected to the second panel 144 in ways other than a fold. However, the terms are intended to inherently include the limitation that the part comprises a portion of an element to be joined by a closure, which part is located to overlap another portion of the same element, such as occurs when one portion of a panel is folded or creased over another. The terms "fold" and "crease" are intended to be equivalent herein, and indicate that a bend is made in an element so that a portion of the element substantially overlaps another portion of the same element.

Also as suggested above, when a surface or side is indicated to be an "interior" surface"or "interior side", it means that it substantially faces the interior space 122. When a surface or side is designated as an "exterior surface" or "exterior side", it means it substantially faces exterior space 124. However the term "outer", particularly when applied to parts associated with fastener 118, refers to surfaces that are exposed to the weather when fastener 118 is closed, while the term "inner" used in the same context refers to surfaces that are encloseable by the closure system; that is, they are enclosed and thus protected from the weather when fastener 118 is closed.

The term "overlying panel" or "overlying portion" is intended to include the portion of the second panel, such as 180, which overlies and covers the exterior of the closure system 106, e.g., the portion 180 of panel 144 from the connection 131 to the connection 141.

First element 108 and second element 110 typically comprise one or more panel-like materials, such as natural or synthetic woven fabrics, plastic, rubber, leather, or other material. Preferably, elements 108, 110 comprise synthetic water-resistant fabric.

Figure 2:
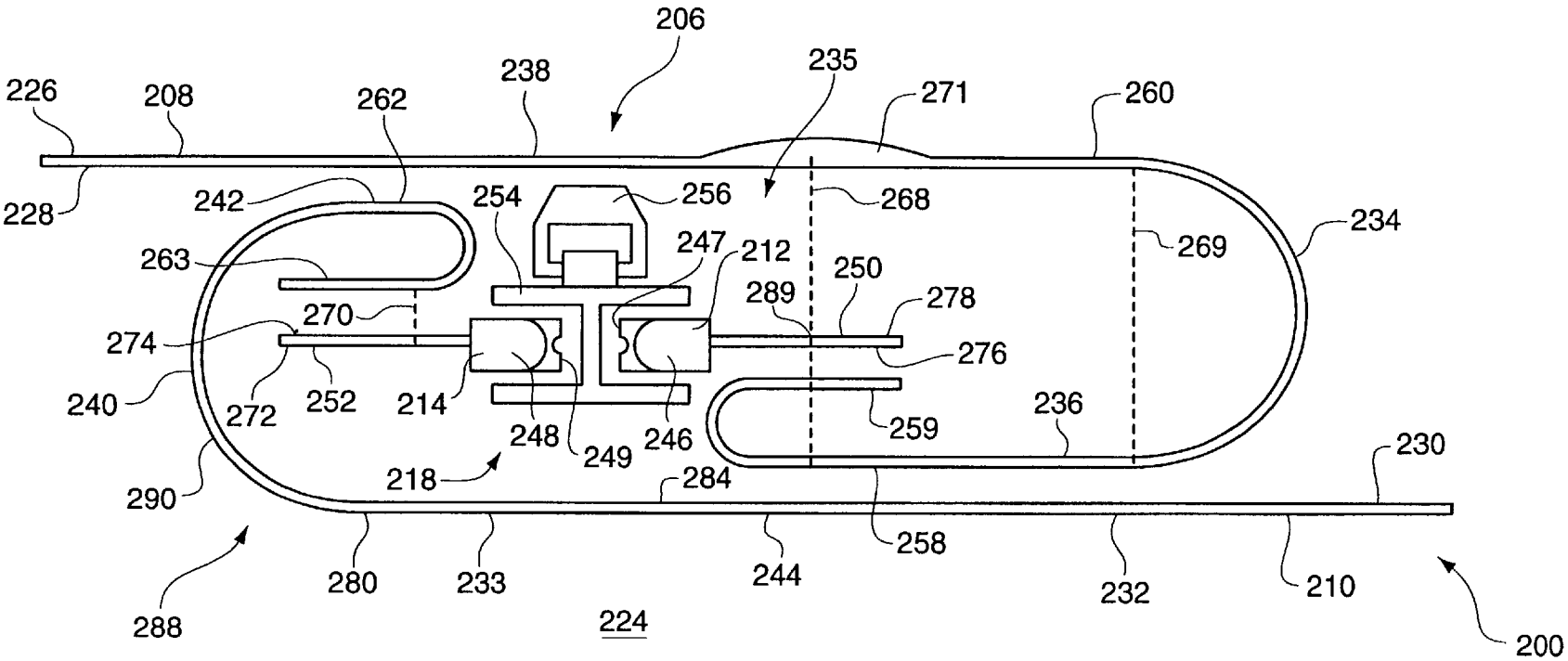
FIG. 2 depicts a top end view of a preferred embodiment of closure system in accordance with the invention.

FIG. 2 shows a preferred embodiment of a closure 206 for closing a portion of an article 200. As depicted in FIG. 2, in this preferred embodiment of a closure system 206 in accordance with the invention, the fastener is a slide fastener 218 having two rows of cooperating slide fastener elements 246, 248, a first stringer tape 250, a second stringer tape 252, and a slider 254 having a pull tab 256. Slide fastener element 246 has a distal end 247, and slide fastener element 248 has a distal end 249. Preferably, the slide fastener elements comprise teeth that engage their counterpart teeth on the opposite side of the slide fastener. The distal ends 247 and 249 are preferably the distal ends of the teeth. First stringer tape 250 is attached to fold part 236 along first longitudinal edge 212, and second stringer tape 252 is attached to crease part 242 along second longitudinal edge 214. A first row of slide fastener elements 246 are mounted on first stringer tape 250 along first longitudinal edge 212, and a second row of slide fastener elements 248 are mounted on second stringer tape 252 along second longitudinal edge 214. Slide fastener element 246 extends away from fold part 236 in the same direction as fold part 236 extends from fold 234, and slide fastener element 248 extends away from crease part 242 in the same direction as crease part 242 extends from fold 240. The distal end 247 of slide fastener element 246 mates with the distal end 249 of slide fastener element 248 to close longitudinal opening 216. Slider 254 cooperates with slide fastener elements 246, 248 to open and close slide fastener 218. Stringer tapes 250, 252 are attached to fold part 236 and crease part 242, respectively, by means of first connector 268 which connects first stringer tape 250 to first panel 238 and second connector 270 which connects second stringer tape 252 to second panel 244. Connectors 268 and 270 are preferably formed by adhesive, though stitching may also be used. If stitching is also used to attach fold part 236 to first panel 238 to maintain longitudinal fold 234, preferably a waterproof sealant, such as seal 271, is disposed on interior surface 226 of first element 208 to cover and seal a stitching seam, represented by dashed line 268. Seal 271 is preferably sealing tape or other sealing means. In contrast to the prior art, attachments between fold part 236, first stringer tape 250 and first panel 238 are preferably achieved by use of glue, other adhesive, or other suitable attaching mechanism. Similarly, second stringer tape 252 is preferably attached to crease part 242 by glue or other adhesive or stitching. The use of glue or other adhesive has the advantage of avoiding a seam, which would then have to be waterproofed for water-resistance. The use of glue or other adhesive has the additional advantage that provides a smoother and more hidden construction of the closure than when stitching is used. Many types of adhesives are commercially available, including solvent-based adhesives, water-based adhesives, powder-based systems, flame bonding adhesives, thermo-plastic hot melt systems and thermo-fusible films. A liquid polyurethane glue is suitable for many applications. Preferably, an adhesive net or web is used. Adhesive nets and webs are easy and convenient to use. They typically produce a discontinuous layer of adhesive that is breathable, flexible and moldable. The thermo-fusible characteristics of these "bonding fabrics" allow adhesive activation by the application of either direct or indirect heat. The most widely used fusing method is the continuous fusing press, but other commonly used methods include infra-red systems calendaring, hot melt lamination, transfer print lamination, radio-frequency/ultra-sonic welding, steam activation and indirect flame lamination. Nets and most webs are typically single polymer systems based upon polyamine, polyester, polyurethane or EVA/olefins chemistry. Each polymer offers its own distinct range of technical properties for the benefit of the user. Adhesive web technology has been further developed with the production of adhesive alloys, which combine two or more polymer types giving the formulator a broader range of technical possibilities and allowing the combination of disparate substrates. Adhesive nets and webs that have been found suitable for application in accordance with the invention are commercially available, for example, from Bostik among its product lines under the trade names Sharnet and Webmelt.

Typically, panel-like material of element 208 is folded back proximate longitudinal edge 212 to form a plurality of panels. As depicted in FIG. 2, fold part 236 comprises an inner fold panel 258 and an outer fold panel 259. Similarly, panel like-material of second element 210 is folded back proximate longitudinal edge 214 to form a plurality of panels. As depicted in FIG. 2, crease part 242 comprises an exposed outer crease panel 262 and an inner crease panel 263. Second stringer tape 252 has an enclosed tape inner surface 272 and an exposed tape outer surface 274. As depicted in FIG. 2, tape outer surface 274 is attached to inner crease panel 263. Similarly, first stringer tape 250 has a tape inner surface 276 and a tape outer surface 278. Typically, first stringer tape 250 is disposed between outer fold panel 259 and first panel 238, whereby tape inner surface 276 is in contact with and attached to outer fold panel 259, and tape outer surface 278 is in contact with and attached to over-lapped portion 260 of first panel 238. As discussed above, tape surface 274 is an exposed surface in that portions of it are exposed to the weather when fastener 218 is fastened, while tape surface 272 is an enclosed surface when fastener 218 is fastened.

Closure system 206 forms a flap 288 having a proximal end 289 at longitudinal seam 268 and a distal end 290 at longitudinal crease 240. Fastener 218 forms part of flap 288. Fastener 218 is oriented so that exposed surfaces 274 and 278 and pull tab 256 face in substantially the same direction as first interior surface 226 and second interior surface 230. The portion 233 of the exterior surface 232 of panel 244 forms the exterior exposed surface 233 of flap 288 while the interior surface 235 of the flap 288 is formed by the exposed portions of outer crease part 262, fastener 218, and outer surfaces 274 and 278 of stringer tapes 250 and 252.

Figure 3:
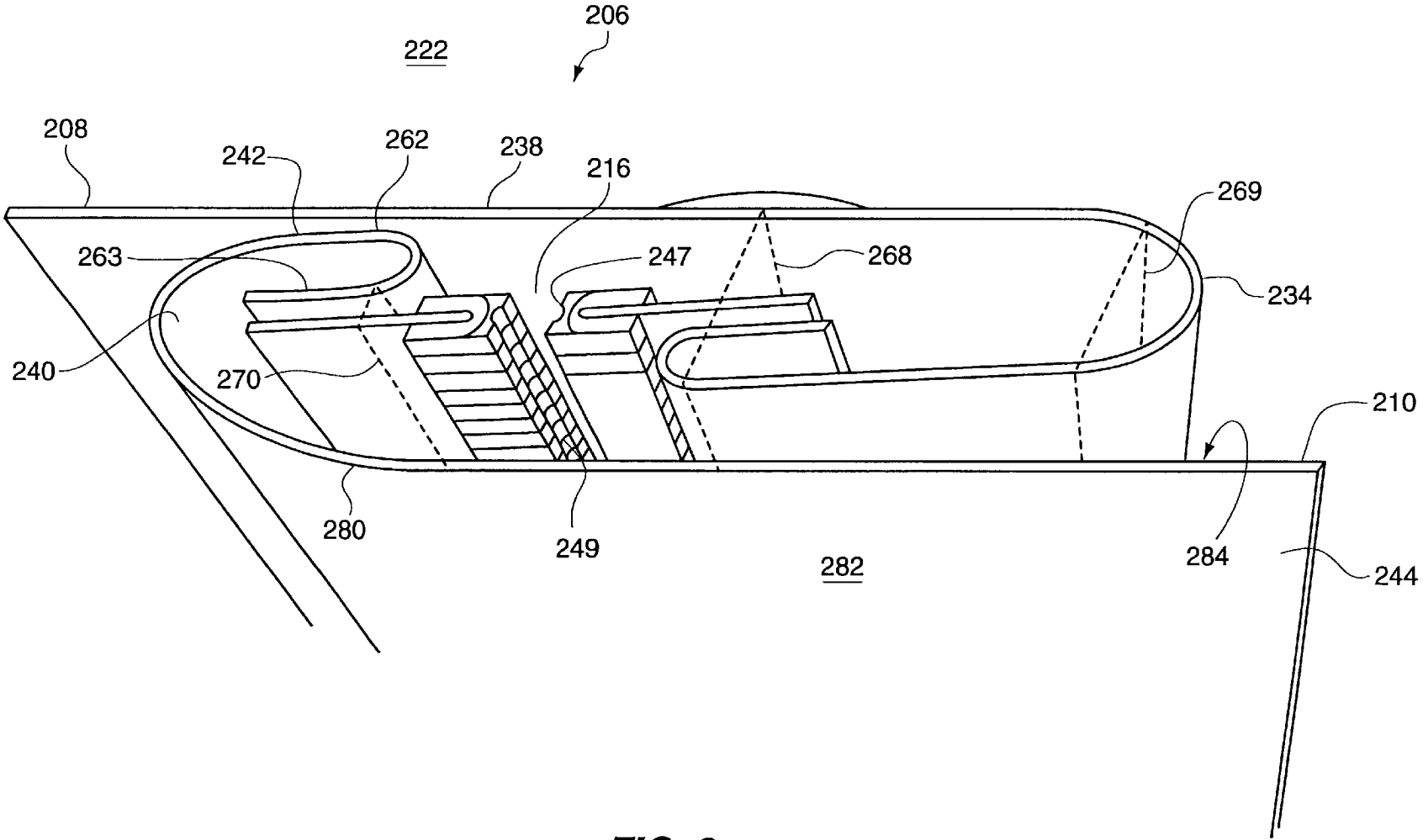
FIG. 3 is a perspective view of the closure of FIG. 2.

FIG. 3 is a perspective view of closure 206. FIG. 3 more clearly depicts the panel-like shape of first element 208 and second element 210. FIG. 3 further shows the longitudinal nature of longitudinal opening 216, the longitudinal connection, i.e., longitudinal fold 234, and longitudinal crease 240. FIG. 3 shows the panel-like shape of inner crease panel 263 and outer crease panel 262 of crease part 242. FIG. 3 further shows the longitudinal stitching seams represented by dashed lines 268, 269, 270. Second element 210 includes a longitudinally overlying portion 280 of second panel 244 which overlies first panel 238 and has an exterior surface 282 bounded by longitudinal crease 240 and an interior surface 284 (see FIG. 2). Interior surface 284 of exposed panel 280 is directly adjacent to fastener 218. Exposed panel 244 of second element 210 is disposed between exterior 224 and slide fastener 218. When fastener 218 is closed, longitudinal opening 216 and fastener 218 are located between first exterior surface 228 and the portion 284 of second interior surface 230 that is associated with the overlying portion 280. As a result, portion 280 of panel 244 shields crease part 242, second stringer tape 252, fastener 218, first stringer tape 250, and fold part 236 from exterior 224. FIGS. 2 and 3 illustrate some of the useful aspects of a closure in accordance with the invention. When slide fastener 218 is closed, slide fastener elements 236, 248 are hidden from view by exposed second panel 244, and are virtually protected from direct exposure to the elements, particularly to rain, snow and ice. Exposed second panel 244 preferably comprises water-resistant material. If water or cold air does seep through slide fastener elements 246, 248 or through slide stringer tapes 250, 252, these undesired elements do not penetrate directly into interior 222; rather they penetrate in an outward direction away from interior 222 towards the interior surface 284 of exposed second panel 244. Furthermore, exposed panel 244 typically has no sewing stitches penetrating through it. This enhances the weather-resistance of the closure 206, as well as improving the appearance. Longitudinal opening 216, fastener elements 246, 248, stringer tapes 250, 252, and stitching seams 268, 269, 270 are hidden from view.

Figure 4:
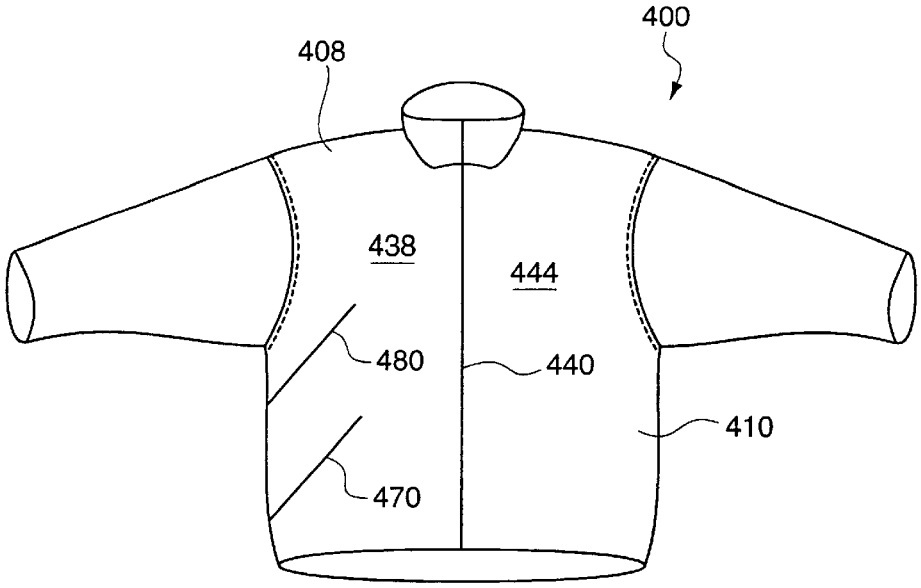
FIG. 4 depicts an athletic jacket in which embodiments of a closure in accordance with the invention is preferably used.
Figure 5:
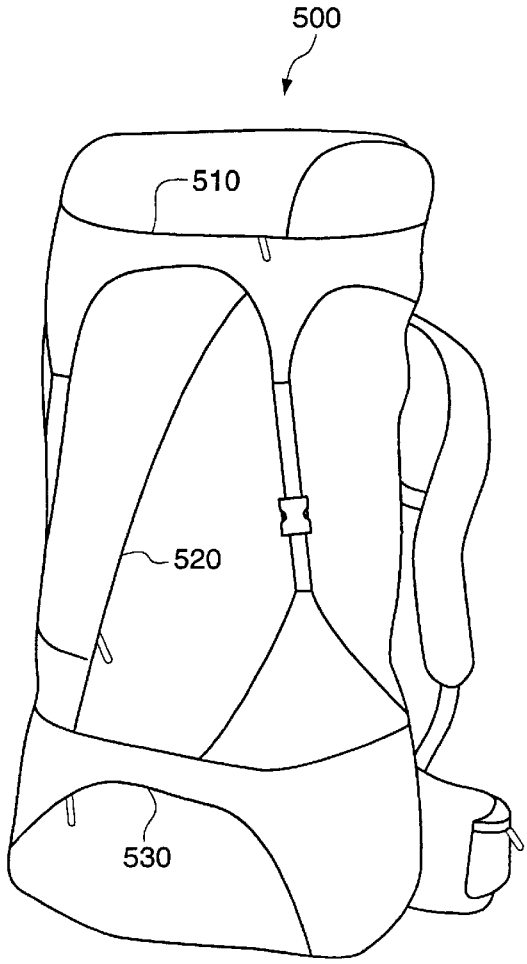
FIG. 5 depicts closures in accordance with the invention used in a backpack.

FIG. 4 depicts an athletic jacket 400 in which embodiments of a closure in accordance with the invention is preferably used. Longitudinal crease 440 indicates the location of a longitudinal jacket opening. Panel-like element 408 including first panel 438 represents the right half of the front of the jacket. Panel-like element 410 includes exposed second panel 444 and represents the left half of the front of jacket 400, and in accordance with the invention, exposed panel 444 lies flat against element 408, creating a pleasing effect. No fastener elements and no stitching are visible-from the outside or are directly exposed to weather elements. Crease 470 indicates the location of a pocket opening. A weather-resistant closure in accordance with the invention protects the interior of the pocket from the elements and provides a smooth surface and a pleasing look. Crease 480 indicates the location of a closure in accordance with the invention that can be opened to provide ventilation at the armpits of jacket 400. FIG. 5 depicts closures 510, 520 and 530 in accordance with the invention used in a backpack 500. It is understood that a closure in accordance with the invention is useful in many different types of clothing articles, for example, apparel such as jackets and pants, footwear, tents, and in many types of luggage and carrying cases, and in any other category of articles having a resealable closure. A closure in accordance with the invention is especially useful in applications requiring strong weather-resistance capabilities. A closure in accordance with the invention may be fabricated using materials and equipment known and used in the art.

FIG. 6 depicts a top cross-sectional view of a closure 606 in accordance with the invention which illustrates the features of flap 688. Flap 688 has a proximal end 670 and a distal end 671. Fastener 618 forms a part of the flap 688 and faces substantially in the same direction as the first interior surface 626 and second interior surface 630. Preferably, first stringer tape 650 is connected to first panel 638 by adhesive first connector layers 698, 699, although stitching 668 and sealant 672 can alternatively be used. If first stringer tape 650 is attached to second panel 644 via fold part 636, then an adhesive layer 697 is most preferably used. Preferably, second stringer tape 652 is attached to second panel 644 by adhesive second connector layers 693 and 695, although stitching 642 can alternatively be used. Either method of attachment will result in exposed second panel 644 lying flat against first element 608. In addition, if adhesive is used, then the closure appears even more attractive, with only crease 640 breaking an otherwise smooth surface formed by first element 608 and exposed second panel 644. Longitudinal opening 616 and slide fastener 618 are not visible from exterior 624. More importantly, because exposed panel 644 lies flat against first element 608, there is virtually no direct exposure of longitudinal opening 616 and slide fastener 618 to weather elements. When fastener 618 is closed, fold part 636, crease part 642, and overlying portion 680 of second panel 644 form a longitudinal flap 688 that covers an overlaid part 684 of first element 608 and that may rotate about stitching 668. Proximal end 670 of flap 688 is connected to first panel 638, while distal end 671 is connected to second panel 644. In this and other embodiments, longitudinal opening 616 and fasteners 618 are on the interior surface of flap 688, shielded from view and from the exterior 624. As depicted in FIG. 6, a closure in accordance with the invention may include a flap fastener 692 for fastening flap 688 to overlaid part 684. Typically, a first flap fastener element 694 is disposed on crease part 642, and a second flap fastener element 696 is disposed on overlaid part 684 opposite first flap fastener element 694. Typically, flap fastener 690 is a hook-and-loop fastener; snap fasteners, magnet fasteners or other types of fasteners may also be used.

Typically, first stringer tape 650 or second stringer tape 652 or both are stiffer or more rigid than most of the waterproof panel-like material included in first and second elements 608, 610. Stiffness of the stringer tapes are related to compositions of material selected to impart greater durability and strength than more flexible materials. Stiff or rigid stringer tapes are useful to maintain the shape of the closure system, thereby preserving a flat, smooth appearance and reducing exposure of the fastener to the outside.

Figure 7:
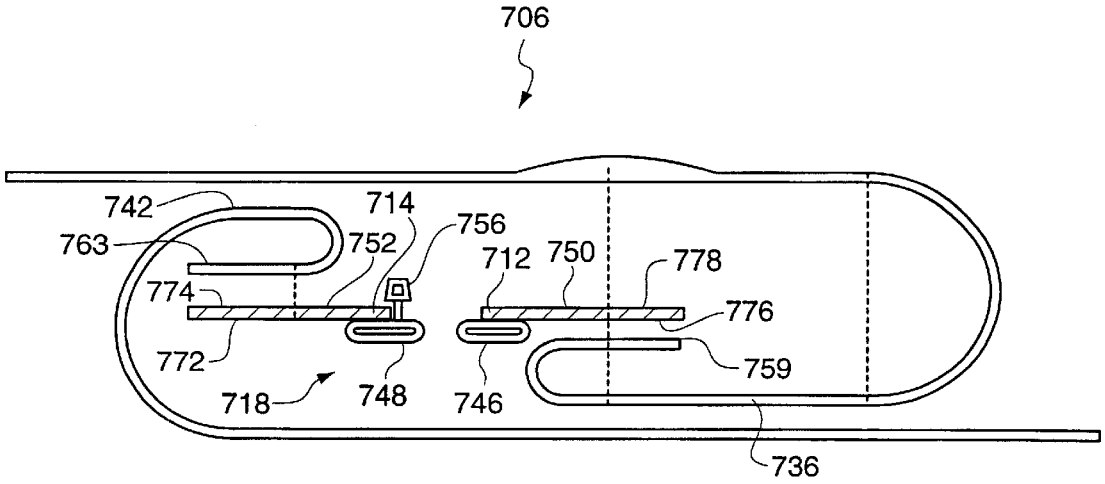
FIG. 7 depicts another embodiment of a closure in accordance with the invention.

Numerous types of fastening devices, in particular, improvements in slide fasteners, have been developed in the art. It is a feature of a closure in accordance with the invention that it may include many variations of fastener devices, both those currently known and those developed in the future, disposed at the longitudinal opening. For example, a weather-resistant slide fastener was disclosed in U.S. Pat. No. 5,008,986, issued Apr. 23, 1991, to Laudet et al., which is hereby incorporated by reference as if fully contained herein. The Laudet et al. patent discloses a slide fastener comprising two stringer tapes and a pull tab, each stringer tape having a chain of teeth. The cooperating chains of teeth of the slide fastener are connected to the interior side of their respective stringer tapes in such a manner that when the fastener is closed, they are located raised on a single side of the tapes, adapted to be turned towards the interior of a longitudinal opening. FIG. 7 depicts a closure 706 in accordance with the invention having a slide fastener 718 similar to the slide fasteners disclosed in Laudet et al. Fastener 718 includes a first stringer tape 750 and a second stringer tape 752. Tape inner surface 776 of stringer tape 750 is attached to outer fold panel 759 of fold part 736. Tape outer surface 774 of second stringer tape 752 is attached to inner crease panel 763 of crease part 742. A first row of cooperating slide fastener elements 746 is mounted on inner tape surface 776 of first stringer tape 750 along first longitudinal edge 712. A second row of cooperating slide fastener elements 748 is mounted on inner tape surface 772 of second stringer tape 752 along longitudinal edge 714. A pulltab 756 is shown permanently mounted along longitudinal edge 714. It is understood that pulltab 756 may be mounted at longitudinal edge 712. When fastener 718 is closed and rows of slide fastener, elements 746, 748 are engaged in a closed position, the slide fastener elements are raised on the tape inner surfaces. This allows longitudinal edge 712 and longitudinal edge 714 of the stringer tapes to come closer together than is typical with conventional slide fasteners. In addition, the engaged slide fastener elements are protected by the stringer tapes from direct exposure to the outside. This enhances resistance of the closure to water and other weather elements because it shields the gaps, empty spaces and flexible joints, which are inherent in slide fasteners and other types of fasteners, from direct exposure to the outside. Resistance to weather elements is especially enhanced when a waterproof coating, such as polyurethane, is applied on the stringer tapes. In the embodiment depicted in FIG. 7, the pulltab extends from the slide fastener elements to the tape outer surfaces 778, 774 of the stringer tapes. The cooperating rows of slide faster elements of a slide fastener may be mounted on the respective stringer tapes in various ways to achieve the desired effect, which is that the slide fastener elements are more impervious to fluids toward the tape outer surfaces than toward the tape inner surfaces.

A variation of a closure in accordance with the invention is depicted in FIG. 8. An embodiment as depicted in FIG. 8 is similar to that of FIG. 7 except that, in FIG. 8, tape outer surface 878 of first stringer tape 850 is attached to inner fold panel 858 of fold part 836. Rows of cooperating slide fastener elements 846, 848 are disposed on tape inner surfaces 876, 872, respectively. Thus, when fastener 818 of closure 806 is in a closed position, fastener elements 846, 848 are shielded from the outside by stringer tapes 850, 852, which are, in turn, shielded from the outside by fold part 836 and crease part 842. Pulltab 856 extends from fastener elements 846, 848 to the outside. The configuration of fold part 836 and first stringer tape 850 in the embodiment of closure 806 provides increased resistance to water and weather elements. It has the disadvantage that first stringer tape 850 is visible from exterior 824 when fastener 818 is open and second element 810 is pulled back from first element 808. For aesthetic purposes, therefore, an embodiment as depicted in FIG. 8 may not necessarily always be desirable. When water-resistance is paramount, however, then an embodiment as in FIG. 8 is preferred.

Preferably, the first element and the second element of a closure in accordance with the invention comprise waterproof panel-like material. Especially when the article in which a closure according to the invention is incorporated is a jacket or a pant, the first element and the second element preferably comprise a breathable waterproof panel-like material. Typically, a breathable waterproof panel-like material is a laminate material comprising a plurality of layers of different composition to provide desired characteristics of water-resistance, water wicking capacity, water vapor permeability, heat insulation, strength, durability, and others. Typically, a breathable waterproof panel-like material comprises two or three layers.

Figure 9:
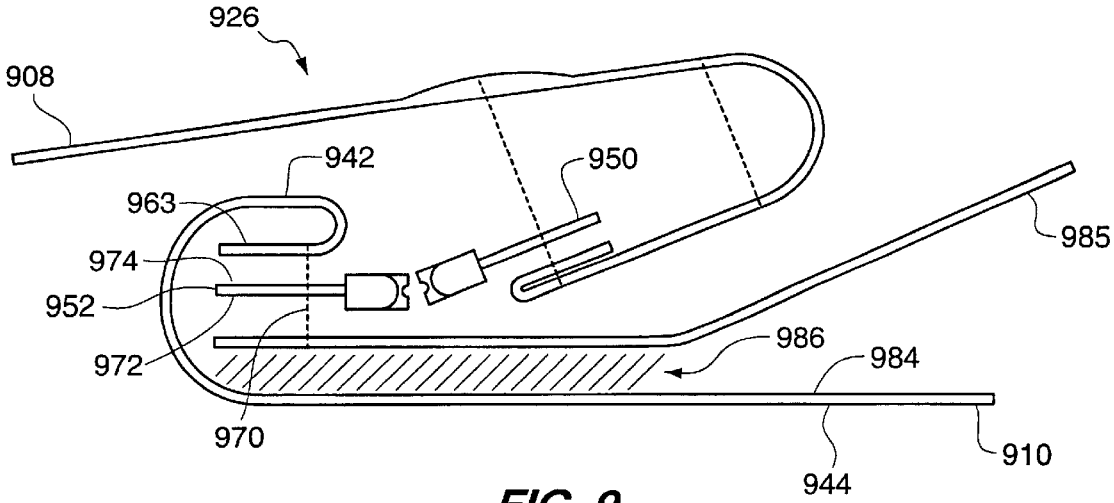
FIGS. 9–12 depict in diagrammatic form examples of embodiments of closures in accordance with the invention that also include a lining.

FIGS. 9–12 depict in diagrammatic form examples of embodiments of closures in accordance with the invention that also include a lining. Typical examples are closures used in sport jackets and pants that comprise a lining for heat insulation or for aesthetic purposes. In carrying bags and luggage, linings are commonly used for various purposes, such as cushioning or sealing. As depicted in FIG. 9, a lining 985 is connected to interior surface 984 of exposed second panel 944 of second element 910. Typically, a lining is also associated with interior surface 926 of first element 908; methods and means for attaching a lining to first element 908 are known in the art. As depicted in FIG. 9, tape outer surface 974 of second stringer tape 952 is connected to inner panel 963 of crease part 942, and lining 985 is disposed between tape inner surface 972 and interior surface 984 of exposed second panel 944. As depicted in FIG. 9, lining 985 is typically attached by stitching (represented by dashed lines 970) to stringer tape 952, and lining 985 is typically attached by adhesive (represented by hatched lines 986) to interior surface 984 of exposed panel 944 of second element 910. For example, a polyurethane glue can be used as adhesive. Preferably, an adhesive film, such as those commercially available from Bostik under its Sharnet and Webmelt trade names, is used as adhesive. When adhesive 986 is used instead of more intrusive means, such as stitching, exterior surface 982 of exposed second panel 944 remains smooth, thereby enhancing its appearance.

Figure 10:
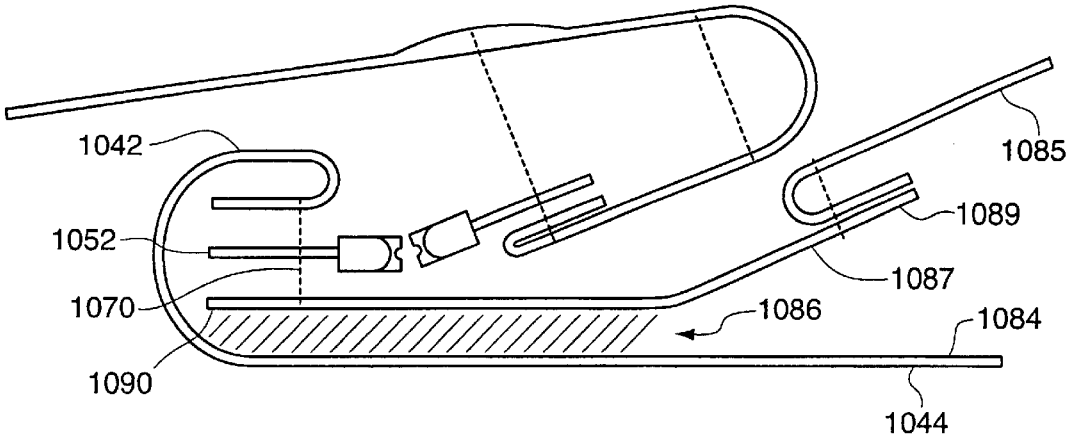

FIG. 10 depicts an embodiment in accordance with the invention further comprising a lining tape 1087 having a lining end 1089 and a crease end 1090, whereby lining tape 1087 is attached at crease end 1090 by adhesive 1086 to interior surface 1084 of exposed panel 1044. Lining tape 1087 is also attached at crease end 1090 to second stringer tape 1052, which is also attached to crease part 1042. Lining 1085 is attached to lining tape 1087 at lining end 1089, thereby being connected to interior surface 1084 of exposed second panel 1044. Lining tape 1087 is typically attached to second stringer tape 1052 by means of sewn stitching 1070, but other means, such as adhesive, can be used instead.

Figure 11:
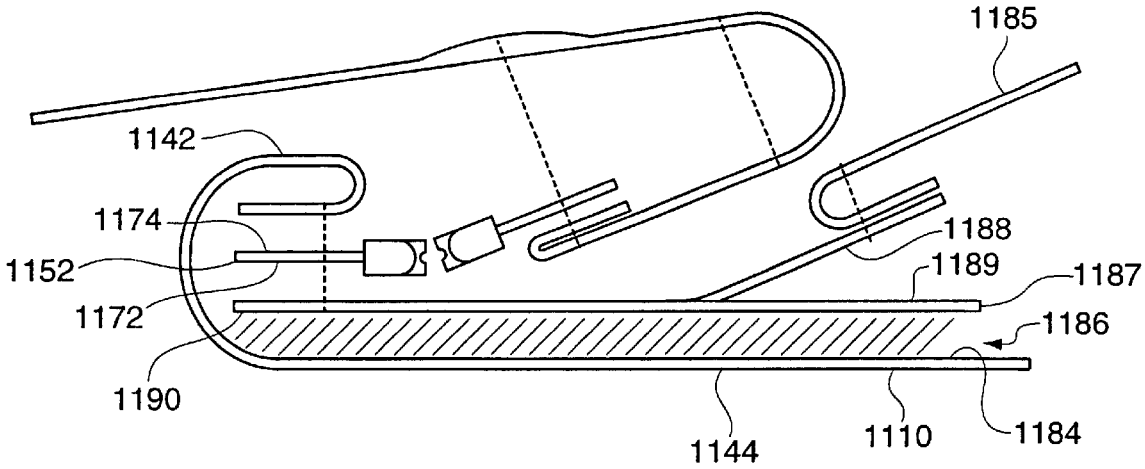

FIG. 11 depicts an embodiment similar to that in FIG. 10 but further comprising a hinged tape tab 1188 disposed at lining end 1189 of lining tape 1187. In such an embodiment, lining tape 1187 is attached to interior surface 1184 of exposed second panel 1144 of second element 1110, preferably by adhesive 1186. As in the embodiment of FIG. 10, crease end 1190 of lining tape 1187 is adjacent to inner surface 1172 of second stringer tape 1152, and outer surface

1174 of second stringer tape 1152 is adjacent and attached to crease part 1142. Lining 1185 is attached to tape tab 1188 and is thereby connected through lining tape 1187 to exposed panel 1144 of second element 1110.

Figure 12:
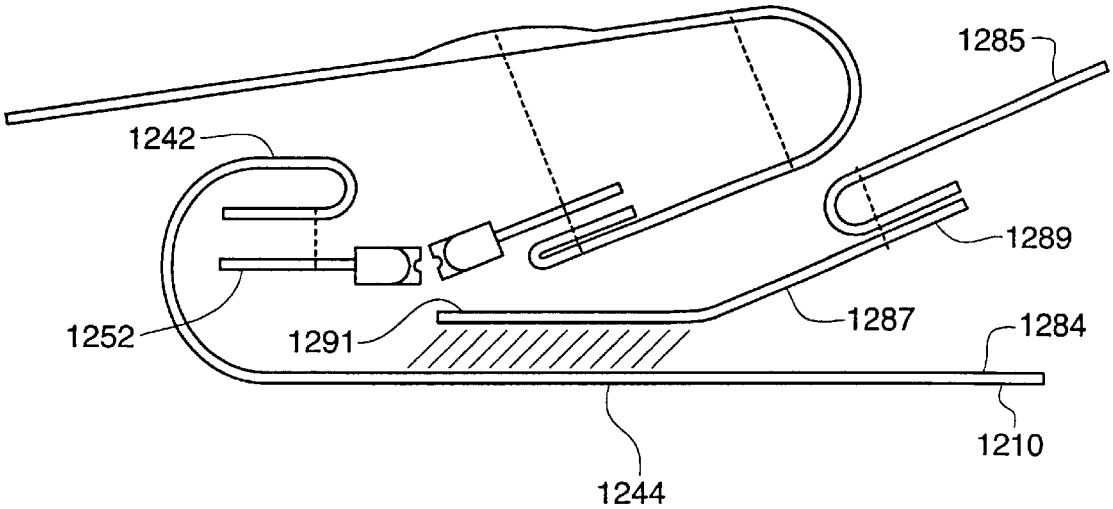

In a further embodiment depicted in FIG. 12, lining 1285 is connected to interior surface 1284 of exposed second panel 1244 of second element 1210 by means of lining tape 1287. Lining 1285 is attached to lining end 1289 of lining tape 1287. Lining tape 1287 is connected at fastener end 1291 by adhesive to interior surface 1284 of exposed panel 1244 of second element 1210. In this type of embodiment, neither lining 1285 nor lining tape 1289 are attached to second stringer tape 1252 or crease part 1242.

There has been described a closure useful for opening and closing a longitudinal opening commonly found in many types of articles, for example, jackets, pants, footwear, carrying cases, luggage, tents and many others. A closure in accordance with the invention increases the resistance to penetration by fluids, in particular, water and air, compared to closures of the prior art. A closure in accordance with the invention is less bulky and less intrusive than many water-resistant closures of the prior art. It also results in a sleek, seamless appearance. It should be understood that the particular embodiments shown in the drawings and described within this specification are for purposes of example and should not be construed to limit the invention, which will be described in the claims below. Further, it is evident that those skilled in the art can now make numerous uses and modifications of the specific embodiments described, without departing from the inventive concepts. It is also evident that equivalent structures and compositions can be substituted for the various structures and compositions described. Consequently, the invention is to be construed as embracing each and every novel feature and novel combination of features present in and/or possessed by this description.

I claim:

1. A hidden closure system for closing a longitudinal opening between an interior space and an exterior space, said closure system comprising:

a first panel, said first panel having a first interior surface and a first exterior surface;

a second panel, said second panel having a second interior surface and a second exterior surface;

said interior surfaces facing said interior space and said exterior surfaces facing said exterior space;

said second interior surface of said second panel overlying said first exterior surface of said first panel in a longitudinal direction;

a fold part, said fold part connected to said first panel along a first longitudinal connection at its proximal end and extending away from said first longitudinal connection in substantially the same direction as said first panel and having a first longitudinal edge at its distal end;

a crease part, said crease part connected to said second panel along a second longitudinal connection at its proximal end and extending away from said second longitudinal connection in the same direction as said second panel and having a second longitudinal edge at its distal end;

said first longitudinal edge and said second longitudinal edge defining said longitudinal opening;

a fastener having an exposed surface and a surface enclosed or enclosable by said closure system, said fastener disposed at said longitudinal opening for joining said first longitudinal edge to said second longitudinal edge, said longitudinal opening and said fastener located between said first exterior surface and said second interior surface, such that when said fastener is closed said exposed surface faces said first exterior surface and said enclosed surface faces said second interior surface.

2. A hidden closure system as in claim 1 wherein said fastener comprises a set of cooperating fastener elements, one of said fastener elements disposed on said fold part and extending in the same direction as said fold part, and one of said fastener elements disposed on said crease part and extending in the same direction as said crease part.

3. A hidden closure system as in claim 1 wherein said first longitudinal connection is a fold in said first panel wherein an end portion of said first panel becomes said fold part and said second longitudinal connection is a crease in said second panel wherein an end portion of said second panel becomes said crease part.

4. A hidden closure system as in claim 1 wherein said longitudinal opening is a front entry of a jacket.

5. A hidden closure system as in claim 1 wherein said longitudinal opening is a ventilation opening of a clothing article.

6. A hidden closure system as in claim 1 wherein said longitudinal opening is a pocket opening of a clothing article.

7. A hidden closure system as in claim 1 wherein said longitudinal opening is an opening in a piece of luggage.

8. A hidden closure system as in claim 1 wherein said fastener comprises a hook-and-loop fastener.

9. A hidden closure system as in claim 1 wherein said fastener system comprises a snap fastener.

10. A hidden closure system as in claim 1 wherein said fastener comprises a first stringer tape, a second stringer tape, and a slider, said first row of slide fastener elements mounted on said first stringer tape, said second row of slide fastener elements mounted on said second stringer tape, said first stringer tape attached to said fold part along said first longitudinal edge, said second stringer tape attached to said crease part along said second longitudinal edge, said slider cooperating with said slide fastener elements to open and close said slide fastener.

11. A hidden closure system as in claim 10 wherein said first stringer tape is attached to said fold part using a first attachment element and said second stringer tape is attached to said crease part utilizing a second attachment element, said attachment elements selected from the group consisting of an adhesive and sewn stitching.

12. A hidden closure system as in claim 10 wherein each of said stringer tapes has a tape inner surface and a tape outer surface, and each respective row of slide fastener elements is mounted on the interior side of each respective stringer tape so that when the slide fastener elements are engaged in a closed position, the slide fastener elements are more impervious to water and air toward the tape outer surfaces than toward the tape inner surfaces.

13. A hidden closure system as in claim 12 wherein said slider includes a pull tab, and said pull tab extends from the inner surface side of said stringer tapes through the outer surface side of said stringer tapes.

14. A hidden closure system as in claim 1 wherein said crease part comprises panel-like material and said crease part comprises a plurality of panels.

15. A hidden closure system as in claim 14 wherein said fastener comprises a first stringer tape, a second stringer tape, and a slider, said first row of slide fastener elements mounted on said first stringer tape, said second row of slide fastener elements mounted on said second stringer tape, said first stringer tape attached to said fold part along said first longitudinal edge, said second stringer tape attached to said crease part along said second longitudinal edge, said slider cooperating with said slide fastener elements to open and close said slide fastener; said crease part has a crease part inner panel and a crease part outer panel; said second stringer tape has a tape inner surface and a tape outer surface; and said tape outer surface is attached to said crease part inner panel.

16. A hidden closure system as in claim 15 wherein said second stringer tape is attached to said crease part inner panel and not to said crease part outer panel.

17. A hidden closure system as in claim 15 wherein said second stringer tape is attached to said crease part inner panel and said crease part inner panel is attached to said crease part outer panel.

18. A hidden closure system as in claim 1 wherein said fold part comprises panel-like material and said fold part comprises a plurality of panels.

19. A hidden closure system as in claim 18 wherein said fastener comprises a first stringer tape, a second stringer tape, and a slider, said first row of slide fastener elements mounted on said first stringer tape, said second row of slide fastener elements mounted on said second stringer tape, said first stringer tape attached to said fold part along said first longitudinal edge, said second stringer tape attached to said crease part along said second longitudinal edge, said slider cooperating with said slide fastener elements to open and close said slide fastener; said fold part has an inner fold panel and an outer fold panel; said first stringer tape is attached to said outer fold panel; and said inner fold panel is attached to said outer fold panel.

20. A hidden closure system as in claim 1, and further including a lining connected to said interior surface of said second panel.

21. A hidden closure system as in claim 20 wherein said fastener comprises a first stringer tape, a first row of slide fastener elements mounted on said first stringer tape, a second stringer tape, a second row of slide fastener elements mounted on said second stringer tape, and a slider, said first stringer tape attached to said fold part along said first longitudinal edge, said second stringer tape attached to said crease part along said second longitudinal edge, said slider cooperating with said slide fastener elements to open and close said slide fastener; said second stringer tape has a tape inner surface and a tape outer surface; and said lining is disposed between said tape inner surface and said interior surface of said second panel.

22. A hidden closure system as in claim 21 wherein said lining is attached by stitching to said second stringer tape, and said lining is attached by adhesive to said interior surface of said second panel.

23. A hidden closure system as in claim 22, and further including a lining tape, and wherein said lining tape is attached to said inner surface of said second stringer tape, and said lining is connected to said lining tape.

24. A hidden closure system as in claim 20, and further comprising a lining tape, said lining tape is attached by adhesive to said interior surface of said second panel, and said lining is connected to said lining tape.

25. A hidden closure system as in claim 24 wherein said lining tape includes a hinged tape tab, and said lining is attached to said hinged tape tab by stitching.

26. A hidden closure system as in claim 1, further comprising longitudinal row of stitching through said fold part and said first panel to attach said fold part to said first panel.

27. A hidden closure system as in claim 26, and further including a waterproof sealant disposed on said first interior surface covering said stitching through said first panel.

28. A hidden closure system as in claim 26 wherein said stitching is proximate said first longitudinal edge.

29. A hidden closure system as in claim 26 wherein said stitching is proximate said first longitudinal connection of said fold part to said first panel.

30. A hidden closure system as in claim 1 wherein said first panel and said second panel comprise waterproof panel-like material.

31. A hidden closure system as in claim 30 wherein said first panel and said second panel comprise breathable waterproof panel-like material.

32. A hidden closure system as in claim 31 wherein said breathable waterproof panel-like material is a laminate material.

33. A hidden closure system as in claim 32 wherein said laminate material comprises two layers.

34. A hidden closure system as in claim 32 wherein said laminate material comprises three layers.

35. A hidden closure system as in claim 30 wherein said first stringer tape and said second stringer tape are stiffer than said waterproof panel-like material.

36. A hidden closure system as in claim 1 wherein said fold part, said crease part, and said fastener together form a flap, and said closure system further comprises a flap fastener for fastening said flap to said first panel.

37. A hidden closure system as in claim 36 wherein said flap fastener comprises a first flap fastener element and a second flap fastener element, said first flap fastener element is disposed on said crease part and said second flap fastener element is disposed on said first panel.

38. A hidden closure system as in claim 36 wherein said flap fastener is a hook-and-loop fastener.

39. A hidden closure system for closing a longitudinal opening comprising:

a first element, said first element having a first inner surface, a first outer surface and a first longitudinal edge;

a second element, said second element having a second inner surface, a second outer surface and a second longitudinal edge, said first longitudinal edge and said second longitudinal edge defining said longitudinal opening;

said inner surfaces being those enclosable by said closure and said outer surfaces being those not enclosable by said closure system;

a longitudinal fold in said first element, said longitudinal fold proximate said first longitudinal edge;

a fold part, said fold part being disposed between said longitudinal fold and said first longitudinal edge, said fold part adjacent to and overlapping a first overlapped panel of said first outer surface, said fold part connected at the longitudinal fold to said first overlapped panel such that it extends from said longitudinal fold in a first lateral direction that is substantially the same direction as said first overlapped panel extends from said longitudinal fold;

a longitudinal crease in said second element, said crease proximate said second longitudinal edge;

a crease part, said crease part being disposed between said longitudinal crease and said second longitudinal edge, said crease part adjacent to and overlapping a second overlapped panel of said second inner surface, said crease part connected at said longitudinal crease to said second overlapped panel such that it extends from said longitudinal crease in a second lateral direction which is opposite to said first lateral direction and in substantially the same direction that said second overlapped panel extends from said longitudinal crease;

said first longitudinal edge and said second longitudinal edge being substantially parallel to and proximate each other; and a fastener disposed at said longitudinal opening for joining said first longitudinal edge to said second longitudinal edge, said longitudinal opening and said fastener located between said first exterior surface and said second interior surface, such that when closed, the inner surface of said fastener faces said second inner surface and the outer surface of said fastener faces said first outer surface.

40. A hidden closure system having an interior and an exterior, said enclosure comprising:

a first panel having a first interior surface and a first exterior surface;

a second panel, said second panel having a second interior surface and a second exterior surface;

said interior surfaces facing said interior and said exterior surfaces facing said exterior, said second panel having a portion longitudinally overlying said first panel with said second interior surface facing said first exterior surface;

a fastener for joining said first panel to said second panel along a longitudinal opening; said fastener having an exposed surface and a surface enclosed or enclosable by said closure system; and a flap connecting said longitudinally overlying portion of said second panel to said first panel, said flap having a proximal end connected to said first panel and a distal end connected to said second panel;

said fastener forming a part of said flap and oriented so that said exposed surface faces in substantially the same direction as said first and second interior surfaces.

41. A hidden closure system as in claim 40 wherein said fastener comprises a slide fastener having a pull tab, and said pull tab extends substantially in the same direction that said first and second interior surfaces face.

42. A hidden closure system as in claim 40 wherein said fastener comprises a first stringer tape, a second stringer tape, and a slider, a first row of slide fastener elements mounted on said first stringer tape, a second row of slide fastener elements mounted on said second stringer tape, said first stringer tape attached near said proximal end of said flap and said second stringer tape attached near said distal end of said flap, said slider cooperating with said slide fastener elements to open and close said slide fastener wherein each of said stringer tapes has a tape inner surface and a tape outer surface, and each respective row of slide fastener elements is mounted on the interior side of each respective stringer tape so that when the slide fastener elements are engaged in a closed position, the slide fastener elements are more impervious to water and air toward the tape outer surfaces than toward the tape inner surfaces.

43. A hidden closure system as in claim 40 wherein said fastener comprises a hook-and-loop fastener.

44. A hidden closure system as in claim 40 wherein said fastener system comprises a snap fastener.

45. A hidden closure system as in claim 40, and further including a lining connected to said second interior surface.

46. A method of making a hidden closure system, said method comprising:

providing a first panel having a first longitudinal edge and a second panel having a second longitudinal edge, each of said panels having an inner side and an outer side;

said inner sides being enclosable by said closure system and said outer sides not being enclosable by said closure system;

folding said first longitudinal edge of said first panel over said outer side of said first panel;

folding said second longitudinal edge of said second panel over the inner side of said second panel;

attaching a first longitudinal row of fastener elements to said first panel at said first longitudinal edge and attaching a second longitudinal row of fastener elements to said second panel at said second longitudinal edge;

overlaying a portion of said first panel with a portion of said second panel along a longitudinal direction to form a flap with said first row of fastener elements aligned with said second row of fastener elements in a manner that they can be connected to attach said first panel to said second panel and enclose said inner sides of said panels; and attaching a lining to said interior side of said second panel.

47. A method of making a hidden closure system as in claim 46 wherein said step of attaching comprises attaching slide fastener elements.

48. A method of making a hidden closure system as in claim 47 wherein said step of attaching slide fastener elements comprises mounting a row of slide fastener elements on the inner side of each of a first stringer tape and a second stringer tape, and connecting said first stringer tape to said first panel at said first longitudinal edge and connecting said second stringer tape to said second panel at said second longitudinal edge, with said inner sides of said tapes facing the same direction as the outer sides of said panels.

49. A method of making a hidden closure system as in claim 46 wherein said step of attaching comprises attaching hook and loop fastener elements.

50. A method of making a hidden closure system as in claim 46 wherein said step of attaching comprises attaching snap fastener elements.

51. A method as in claim 46 and further including the step of attaching a flap fastener for permitting said flap to be attached to said first panel.

* * * * *